US010446996B2

(12) United States Patent
Zacharko

(10) Patent No.: US 10,446,996 B2
(45) Date of Patent: Oct. 15, 2019

(54) HYDROPLANING REDUCING SLIP RING APPARATUS

(71) Applicant: Halliburton Energy Services, Inc., Houston, TX (US)

(72) Inventor: Jonathan Peter Zacharko, Edmonton (CA)

(73) Assignee: Haliburton Energy Services, Inc., Houston, TX (US)

( * ) Notice: Subject to any disclaimer, the term of this patent is extended or adjusted under 35 U.S.C. 154(b) by 29 days.

(21) Appl. No.: 15/950,933

(22) Filed: Apr. 11, 2018

(65) Prior Publication Data

US 2018/0233869 A1 Aug. 16, 2018

Related U.S. Application Data

(63) Continuation of application No. 15/177,700, filed on Jun. 9, 2016, now Pat. No. 9,985,402, which is a (Continued)

(51) Int. Cl.
*E21B 7/04* (2006.01)
*E21B 17/02* (2006.01)
(Continued)

(52) U.S. Cl.
CPC ..... *H01R 39/46* (2013.01); *E21B 3/00* (2013.01); *E21B 4/00* (2013.01); *E21B 7/04* (2013.01);
(Continued)

(58) Field of Classification Search
CPC ... E21B 7/04; E21B 7/046; E21B 7/06; E21B 7/062; E21B 17/028; H01R 39/08; H01R 39/12; H01R 43/14; H01R 39/10
See application file for complete search history.

(56) References Cited

U.S. PATENT DOCUMENTS 1,495,780 A 5/1924 Eschholz et al.
2,153,049 A 4/1939 Myers
(Continued)

FOREIGN PATENT DOCUMENTS

| | | |
|---|---|---|
| EP | 1643602 | 4/2006 |
| GB | 2389967 | 12/2003 |
| WO | 2013098312 | 7/2013 |

OTHER PUBLICATIONS

Horne, Walter B. et al., "Review of Causes and Alleviation of Low Tire Traction on Wet Runways", NASA Technical Note D-4406, Washington, D.C., Apr. 1968 (39 pages).

*Primary Examiner* — Kenneth L Thompson
(74) *Attorney, Agent, or Firm* — Terrence N. Kuharchuk; Parlee McLaws LLP; Craig W. Roddy

(57) ABSTRACT

A slip ring apparatus including a ring assembly having a conductive ring with a conductive ring engagement surface, a contact assembly having a contact element with a contact element engagement surface for engaging with the conductive ring engagement surface, and a surface discontinuity provided in at least one of the conductive ring engagement surface and the contact element engagement surface. An apparatus including the slip ring apparatus, wherein the apparatus includes a housing having an interior and a shaft rotatably extending through the interior of the housing. A method for reducing the potential of a hydroplaning effect in a slip ring apparatus, including providing a surface discontinuity in at least one of a conductive ring engagement surface and a contact element engagement surface.

20 Claims, 5 Drawing Sheets

Related U.S. Application Data continuation of application No. 14/079,158, filed on Nov. 13, 2013, now Pat. No. 9,391,417.

(51) Int. Cl.

| | |
|---|---|
| ***H01R 39/08*** | (2006.01) |
| ***H01R 39/46*** | (2006.01) |
| ***E21B 3/00*** | (2006.01) |
| ***E21B 4/00*** | (2006.01) |
| ***H01R 39/18*** | (2006.01) |
| ***H01R 39/58*** | (2006.01) |
| *E21B 47/00* | (2012.01) |

(52) U.S. Cl.

CPC ..... *E21B 17/028* (2013.01); *H01R 39/08* (2013.01); *H01R 39/18* (2013.01); *H01R 39/58* (2013.01); *E21B 47/00* (2013.01); *Y10T 29/49002* (2015.01)

(56) References Cited

U.S. PATENT DOCUMENTS

| | | | | |
|---|---|---|---|---|
| 2,389,214 | A | 11/1945 | Shobert | |
| 2,543,301 | A | 2/1951 | Ramadanoff | |
| 2,671,865 | A | 3/1954 | Nippert | |
| 4,447,752 | A | 5/1984 | Boyce et al. | |
| 4,537,457 | A | 8/1985 | Davis, Jr. et al. | |
| 4,544,215 | A | 10/1985 | Fritsch | |
| 5,334,801 | A | 8/1994 | Mohn | |
| 6,244,361 | B1 | 6/2001 | Comeau et al. | |
| 6,769,499 | B2 | 8/2004 | Cargill et al. | |
| 6,899,174 | B2 | 5/2005 | Maxwell et al. | |
| 8,157,002 | B2 | 4/2012 | Clarkson et al. | |
| 9,007,233 | B2 | 4/2015 | Sugiura | |
| 9,284,793 | B2 * | 3/2016 | D'Silva | H01R 39/385 |
| 9,391,417 | B2 | 7/2016 | Zacharko | |
| 9,985,402 | B2 * | 5/2018 | Zacharko | H01R 39/46 |
| 2015/0129319 | A1 | 5/2015 | D'Silva et al. | |

* cited by examiner

HYDROPLANING REDUCING SLIP RING APPARATUS

CROSS-REFERENCES TO RELATED APPLICATIONS

This application is a continuation of application Ser. No. 15,177,700, filed Jun. 9, 2016, now U.S. Pat. No. 9,985,402, which is a continuation of application Ser. No. 14/079,158, filed Nov. 13, 2013, now U.S. Pat. No. 9,391,417.

TECHNICAL FIELD

A slip ring apparatus for reducing potential hydroplaning between a ring assembly and a contact assembly.

BACKGROUND OF THE INVENTION

Slip ring apparatus are commonly used in a variety of applications to transfer electrical energy, including electrical power and/or signals, over one or more channels between portions of an apparatus which experience relative rotation.

As a non-limiting example, slip ring apparatus may be used in a variety of downhole applications as components of apparatus which are adapted to be inserted within boreholes. Such apparatus may include without limitation, borehole drilling apparatus, wellbore completion apparatus, wellbore logging apparatus, and/or wellbore production apparatus.

A slip ring apparatus may be immersed in a dielectric fluid during its operation. The dielectric fluid creates the potential for a "hydroplaning effect" in which the dielectric fluid may cause the components of the slip ring apparatus to lose contact as they rotate relative to each other.

The potential hydroplaning effect tends to increase with the viscosity of the dielectric fluid and with the relative speed of rotation between the components of the slip ring apparatus. An increased viscosity of the dielectric fluid is a risk factor for "viscous hydroplaning." An increased relative speed of rotation is a risk factor for "dynamic hydroplaning."

The viscosity of the dielectric fluid in which a slip ring apparatus is immersed may vary, depending upon the operational temperature and requirements of the apparatus in which the slip ring apparatus is used and the properties of the dielectric fluid.

As the viscosity of the dielectric fluid increases and the relative speed of rotation between the components of the slip ring apparatus increases, the tendency of the components of the slip ring apparatus to lose contact due to the potential hydroplaning effect may tend to increase.

BRIEF DESCRIPTION OF DRAWINGS

Embodiments of the invention will now be described with reference to the accompanying drawings, in which.

DETAILED DESCRIPTION

Figure 1:
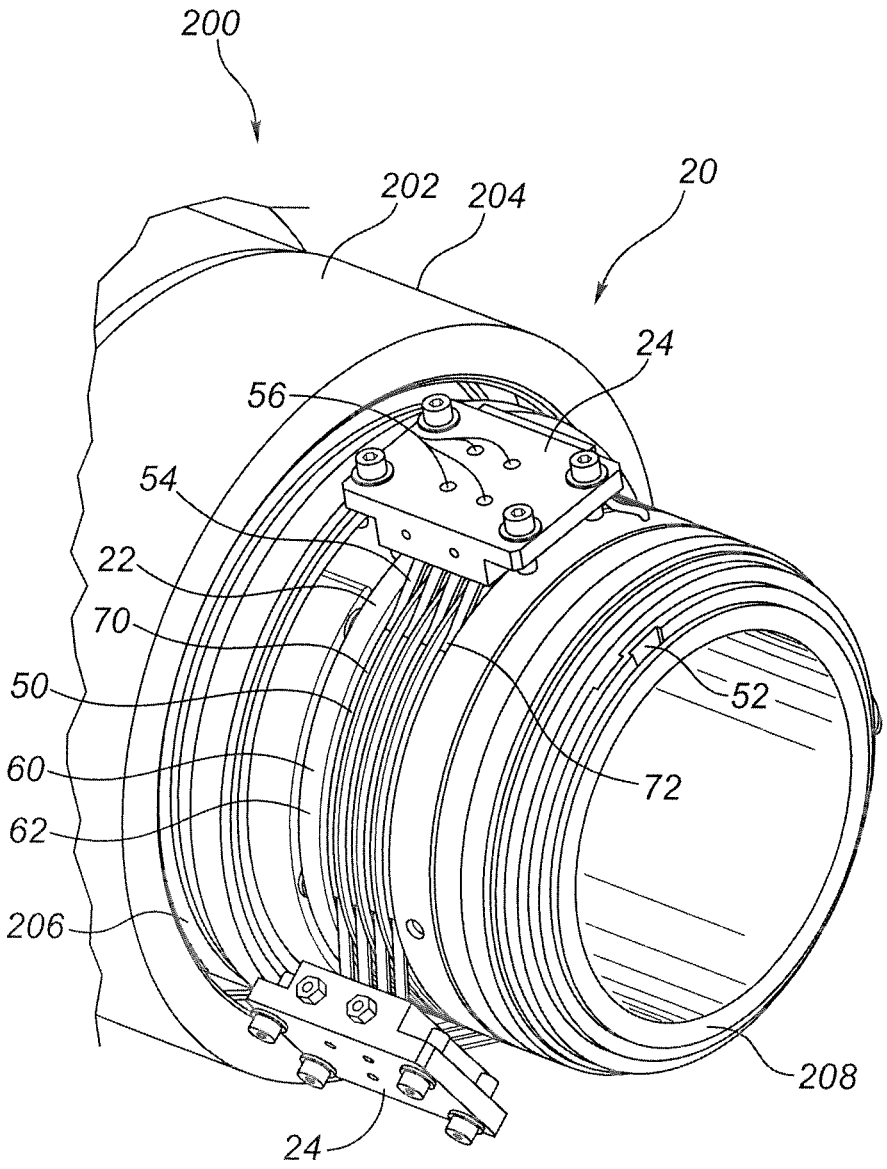
FIG. 1 is a pictorial view of an exemplary embodiment of a slip ring apparatus comprising a ring assembly and three contact assemblies as a component of an exemplary rotary steerable drilling apparatus, wherein the ring assembly is comprised of four conductive rings and each of the contact assemblies is comprised of four pairs of contact elements.

References in this document to orientations, to operating parameters, to ranges, to lower limits of ranges, and to upper limits of ranges are not intended to provide strict boundaries for the scope of the disclosure, but should be construed to mean "approximately" or "about" or "substantially", within the scope of the teachings of this document, unless expressly stated otherwise.

The present disclosure is directed at a slip ring apparatus, at a variety of apparatus comprising the slip ring apparatus, and at a method of reducing the potential of a hydroplaning effect in a slip ring apparatus.

The slip ring apparatus may be used in any apparatus in which it is desired to transfer electrical energy, including electrical power and/or signals, over one or more channels between portions of the apparatus which experience relative rotation.

In some embodiments, the apparatus in which the slip ring apparatus is used may be configured to be inserted within a borehole. In some embodiments, the apparatus in which the slip ring apparatus is used may be an apparatus for use in drilling a borehole. In some embodiments, the apparatus in which the slip ring apparatus is used may be a drilling motor. In some embodiments, the apparatus in which the slip ring apparatus is used may be a rotary steerable drilling apparatus.

The slip ring apparatus is comprised of a ring assembly and at least one contact assembly. The ring assembly and the at least one contact assembly are electrically connected with each other and are rotatable relative to each other.

Either or both of the ring assembly and the at least one contact assembly may rotate in order to provide relative rotation between the ring assembly and the at least one contact assembly. In some embodiments, the at least one contact assembly may be associated with a relatively stationary component of the apparatus and the ring assembly may be associated with a relatively rotating component of the apparatus. In some embodiments, the at least one contact assembly may be associated with a relatively rotating component of the apparatus and the ring assembly may be associated with a relatively stationary component of the apparatus.

In some embodiments, the slip ring apparatus may be comprised of a plurality of contact assemblies to provide redundancy and/or to facilitate a plurality of electric paths or channels.

In some embodiments, the apparatus in which the slip ring apparatus is used may be comprised of a housing and a shaft which rotatably extends through the interior of the housing.

In some embodiments in which the apparatus is comprised of a housing and a shaft, the ring assembly may be connected with the shaft so that the ring assembly rotates with the shaft. In some embodiments in which the apparatus is comprised of a housing and a shaft, the at least one contact assembly may be connected with the shaft so that the at least one contact assembly rotates with the shaft.

In some embodiments in which the apparatus is comprised of a housing and a shaft, the at least one contact assembly may be mounted within the interior of a housing which contains the ring assembly so that the ring assembly is rotatable relative to the at least one contact assembly. In some embodiments in which the apparatus is comprised of a housing and a shaft, the ring assembly may be mounted within the interior of a housing which contains the at least one contact assembly so that the ring assembly is rotatable relative to the at least one contact assembly.

In some embodiments, the slip ring apparatus may be further comprised of a dielectric fluid. The ring assembly and the at least one contact assembly may be immersed in the dielectric fluid. In some embodiments, the slip ring apparatus may be further comprised of a dielectric fluid chamber surrounding the ring assembly and the at least one contact assembly, for containing the dielectric fluid.

In some embodiments, the ring assembly may be comprised of at least one electrically conductive ring. In some embodiments, the ring assembly may be comprised of a plurality of conductive rings to provide redundancy and/or to facilitate a plurality of electric paths or channels. Each conductive ring may be comprised of a conductive ring engagement surface.

In some embodiments, each contact assembly may be comprised of at least one electrically conductive contact element. In some embodiments, a contact assembly may be comprised of a plurality of contact elements to provide redundancy and/or to facilitate a plurality of electric paths or channels. Each contact element may be comprised of a contact element engagement surface, for engaging with a conductive ring engagement surface.

The at least one conductive ring and the at least one contact element may be configured relative to each other in any suitable manner which provides an electrical connection between the ring assembly and the at least one contact assembly. In some embodiments, a conductive ring engagement surface and a corresponding contact element engagement surface may be substantially perpendicular to a plane which is normal to the axis of relative rotation between the ring assembly and the at least one contact assembly. In some embodiments, a conductive ring engagement surface and a corresponding contact element engagement surface may be substantially parallel to a plane which is normal to the axis of relative rotation between the ring assembly and the at least one contact assembly.

The conductive ring engagement surface of a conductive ring of a ring assembly may be engaged with the contact element engagement surface of at least one contact element of a contact assembly so that the ring assembly is electrically connected with the contact assembly. The contact element engagement surfaces of each contact element of a contact assembly may be engaged with the conductive ring engagement surface of at least one conductive ring of a ring assembly so that the ring assembly is electrically connected with the contact assembly.

Each contact assembly engages the ring assembly with an engagement force. In some embodiments, each contact element of a contact assembly engages a conductive ring of the ring assembly with an engagement force. In some embodiments, each contact element engagement surface engages a conductive ring engagement surface with an engagement force.

A surface discontinuity may be provided in at least one of the conductive ring engagement surface and the contact element engagement surface in an engagement between a conductive ring and a contact element. In some embodiments, a surface discontinuity may be provided in at least one of the conductive ring engagement surface and the contact element engagement surface in a plurality of engagements between a conductive ring and a contact element. In some embodiments, a surface discontinuity may be provided in at least one of the conductive ring engagement surface and the contact element engagement surface in each engagement between a conductive ring and a contact element.

A surface discontinuity may be comprised of any texture or shape which interrupts the smoothness of an engagement surface without preventing a continuous electrical connection between a conductive ring and a contact element during relative rotation of the conductive ring and the contact element.

As non-limiting examples, a surface discontinuity may be comprised of texturing, roughness and/or one or more recesses, holes, grooves, ribs and/or blocks. In some embodiments, a surface discontinuity may be random (i.e., may not exhibit a surface discontinuity pattern). In some embodiments, a surface discontinuity may exhibit a surface discontinuity pattern.

In some embodiments, a surface discontinuity and/or a surface discontinuity pattern may be comprised of at least one groove, wherein a groove is an elongated discontinuity in an engagement surface which is recessed relative to other portions of the engagement surface. Accordingly, a groove may be provided in an engagement surface by providing a recess in the engagement surface or by providing raised portions in the engagement surface adjacent to the groove. In some embodiments, a surface discontinuity and/or a surface discontinuity pattern may be comprised of a plurality of grooves.

A groove may have any shape, depth, cross-section, and/or length within an engagement surface. In some embodiments, a groove may be straight. In some embodiments, a groove may be curved. In some embodiments, a groove may be comprised of angled segments. A groove may be oriented in any direction within an engagement surface. In some embodiments, a groove may be a longitudinal groove, a transverse groove, an oblique groove, or a combination thereof. In some embodiments, a plurality of grooves may be comprised of longitudinal grooves, transverse grooves, oblique grooves, or combinations thereof.

In some embodiments, a surface discontinuity and/or a surface discontinuity pattern in an engagement between a conductive ring and a contact element may be provided in the conductive ring engagement surface. In some embodiments, a surface discontinuity and/or a surface discontinuity pattern in an engagement between a conductive ring and a contact element may be provided in the contact element engagement surface.

In some embodiments, a surface discontinuity and/or a surface discontinuity pattern in an engagement between a conductive ring and a contact element may be provided in both the conductive ring engagement surface and the contact element engagement surface.

In some particular embodiments, a first surface discontinuity and/or a first surface discontinuity pattern may be provided in the conductive ring engagement surface and a second surface discontinuity and/or a second surface discontinuity pattern may be provided in the contact element engagement surface. In some such embodiments, the first surface discontinuity and/or the first surface discontinuity pattern may be the same as the second surface discontinuity and/or the second surface discontinuity pattern. In some such embodiments, the first surface discontinuity and/or the first surface discontinuity pattern may be different from the second surface discontinuity and/or the second surface discontinuity pattern.

In some embodiments, a surface discontinuity and/or a surface discontinuity pattern may provide an indicator of wear of a conductive ring and/or a contact element. In some embodiments, the indicator of wear may be comprised of the depth of a groove and/or the extent to which a surface discontinuity and/or a surface discontinuity pattern is recognizable in a conductive ring engagement surface and/or a contact element engagement surface.

In some embodiments, a method of reducing the potential of a hydroplaning effect in a slip ring apparatus may be comprised of providing a surface discontinuity and/or a surface discontinuity pattern in a conductive ring engagement surface and/or in a contact element engagement surface.

Figure 2:
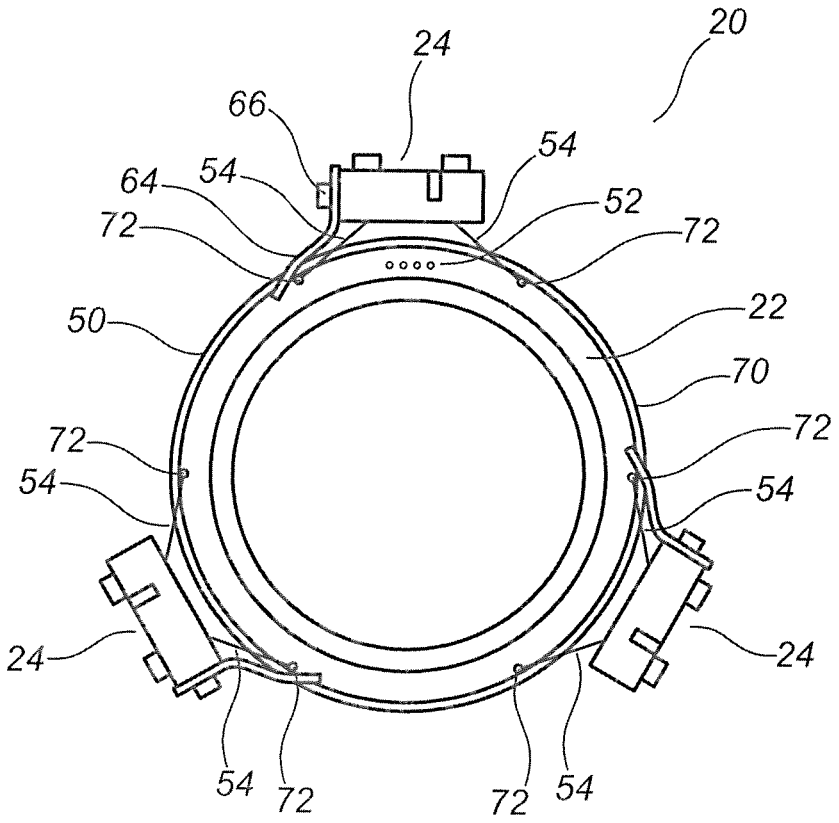
FIG. 2 is transverse section view of the exemplary embodiment of a slip ring apparatus depicted in FIG. 1, in isolation from the exemplary rotary steerable drilling apparatus.
Figure 4:
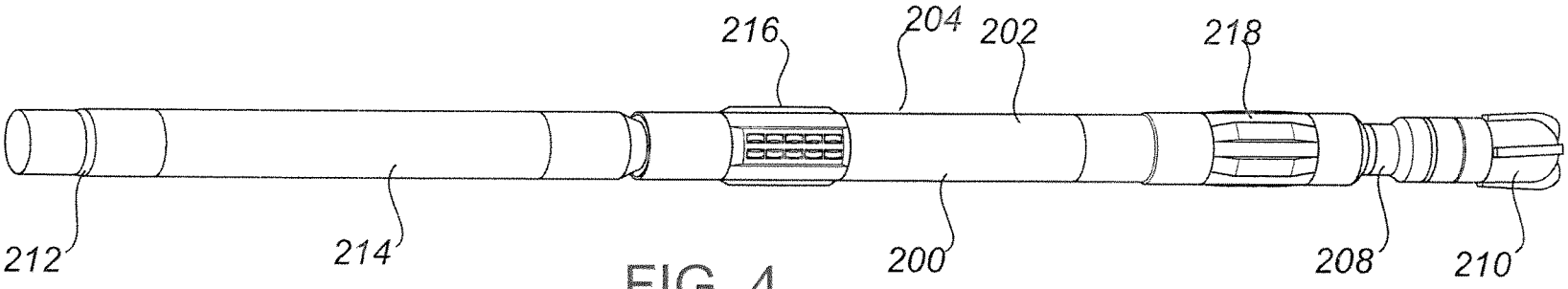
FIG. 4 is a pictorial view of an exemplary rotary steerable drilling apparatus, shown connected with a drill string.
Figure 5:
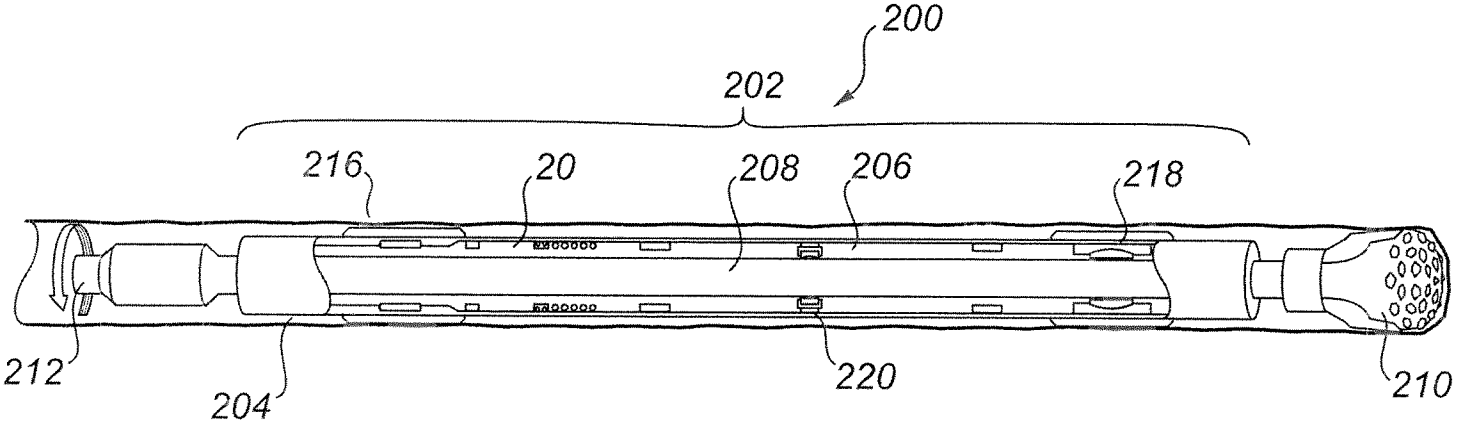
FIG. 5 is a schematic longitudinal section assembly view of the exemplary rotary steerable drilling apparatus depicted in FIG. 4, shown disconnected from the drill string.

FIGS. 1-2 depict an exemplary embodiment of a slip ring apparatus, in which the slip ring apparatus may be provided as a component of an apparatus such as a rotary steerable drilling apparatus. FIGS. 3A-3H depict exemplary embodiments of surface discontinuities and/or surface discontinuity patterns which may be suitable for use in the slip ring apparatus. FIGS. 4-5 depict an exemplary rotary steerable drilling apparatus in which the slip ring apparatus may be used.

Other embodiments of the slip ring apparatus and other embodiments of surface discontinuities and/or surface discontinuity patterns may be included in other apparatus within the scope of the present disclosure.

Referring to FIGS. 1-2, an exemplary embodiment of slip ring apparatus (20) is depicted as a component of an exemplary rotary steerable drilling apparatus (200).

As non-limiting examples, the exemplary rotary steerable apparatus (200) may be a rotary steerable drilling apparatus of the type described in U.S. Pat. No. 6,244,361 (Comeau et al) and/or U.S. Pat. No. 6,769,499 (Cargill et al). As a non-limiting example, the slip ring apparatus (20) may be used in these apparatus to replace or supplement the electromagnetic coupling device which provides a communication link between the housing and the shaft in these rotary steerable drilling apparatus.

Referring to FIG. 1 and FIGS. 4-5, the exemplary rotary steerable drilling apparatus (200) is comprised of a housing (202) having an exterior (204) and an interior (206). A shaft (208) extends through the interior (206) of the housing (202). The shaft (208) is rotatable relative to the housing (202).

In the exemplary rotary steerable apparatus (200), a drill bit (210) is connected with a distal end of the shaft (208), and a drill string (212) is connected with a proximal end of the shaft (208). The drill string (212) may include a drill string communication system (214) such as a measurement-while-drilling system.

In the exemplary rotary steerable drilling apparatus (200), an anti-rotation device (216) is connected with or integrated into the housing (202) adjacent to a proximal end of the housing (202), and a near-bit stabilizer (218) is connected with or integrated into the housing (202) adjacent to a distal end of the housing (202).

In the exemplary rotary steerable drilling apparatus (200), a deflection mechanism (220) is contained within the housing (202), for deflecting the shaft (208) in order to provide a desired drilling direction.

Referring again to FIGS. 1-2, the exemplary embodiment of the slip ring apparatus (20) is comprised of one ring assembly (22) and three contact assemblies (24).

In the exemplary embodiment, the ring assembly (22) is connected with the shaft (208) so that the ring assembly (22) is contained within the interior (206) of the housing (202) and so that the ring assembly (22) is rotatable with the shaft (208) relative to the housing (202). The ring assembly (22) may be connected with the shaft (208) in any suitable manner.

In the exemplary embodiment, the contact assemblies (24) are mounted within the interior (206) of the housing (202) so that the ring assembly (22) is rotatable relative to the contact assemblies (24).

In other embodiments, the contact assemblies (24) may be connected with the shaft (208) and the ring assembly (22) may be associated with the housing (202) so that the ring assembly (22) is rotatable relative to the contact assemblies (24).

The ring assembly (22) is comprised of at least one electrically conductive ring (50).

In the exemplary embodiment, the ring assembly (22) is comprised of four electrically conductive rings (50) separated by a dielectric material. In the exemplary embodiment, the four conductive rings (50) provide four separate electrical channels or paths.

Referring to FIG. 2, the four conductive rings (50) are electrically connected with four electrical leads (52) which extend axially through the ring assembly (22) and which may be connected with electrical power and/or communication devices (not shown) which may be associated with the shaft (208).

Each of the contact assemblies (24) is comprised of at least one electrically conductive contact element (54). A contact element (54) may be comprised of any suitable structure, device or apparatus including, without limitation, a brush or a finger. In the exemplary embodiment, each contact element (54) is comprised of an elongated flat metal finger or strip.

In the exemplary embodiment, each of the contact assemblies (24) is comprised of four pairs of electrically conductive contact elements (54).

In the exemplary embodiment, each of the pairs of contact elements (54) is engaged with one of the conductive rings (50) on the ring assembly (22), so that each of the contact assemblies (24) is electrically connected with the ring assembly (22) to provide four separate electrical channels or paths and two contact elements (54) for each electrical channel or path, and so that the three contact assemblies (24) provide redundancy to assist in maintaining a constant electrical connection between the ring assembly (22) and at least one of the contact assemblies (24).

Referring to FIG. 1, the four pairs of contact elements (54) are electrically connected with four electrical leads (56) which extend radially through the contact assemblies (24) and which may be connected with electrical power and/or communication devices (not shown) which may be associated with the housing (202).

In the exemplary embodiment, the slip ring apparatus (20) is further comprised of a dielectric fluid chamber (60) which surrounds the ring assembly (22) and the contact assemblies (24). In the exemplary embodiment, the dielectric fluid chamber (60) is defined within the rotary steerable drilling apparatus (200). A dielectric fluid (62) is contained in the dielectric fluid chamber (60) so that the ring assembly (22) and the contact assemblies (24) are immersed in the dielectric fluid (62).

Referring to FIG. 2, in the exemplary embodiment, a fluid shield (64) is mounted on the "leading side" of the contact assemblies (24) so that the interface of engagement between the ring assembly (22) and the contact assemblies (24) is at least partially isolated from the circulation of the dielectric fluid (62) within the dielectric fluid chamber (60). In the exemplary embodiment, each fluid shield (64) is mounted to the leading side of the contact assemblies (24) with fluid shield screws (66). Only one fluid shield (84) is depicted in FIG. 2.

Referring to FIGS. 1-2, each of the conductive rings (50) is comprised of a conductive ring engagement surface (70) and each of the contact elements (54) is comprised of a contact element engagement surface (72). The contact element engagement surfaces (72) engage with the conductive ring engagement surfaces (70) in order to electrically connect the ring assembly (22) with the contact assemblies (24).

In the exemplary embodiment, the conductive ring engagement surfaces (70) and the contact element engagement surfaces (72) are oriented in a plane which is substantially perpendicular to a plane which is normal to the axis of relative rotation between the ring assembly (22) and the contact assemblies (24). In other embodiments, the engagement surfaces (70, 72) may be oriented in a plane which is substantially parallel to a plane which is normal to the axis of relative rotation between the ring assembly (22) and the contact assemblies (24), or at some other orientation.

The conductive rings (50) rotate relative to the contact elements (54) during the operation of the slip ring apparatus (20). As a result, the conductive ring engagement surfaces (70) may be considered to extend for the full circumferential length of the conductive rings (50), since every portion of the circumferential length of the conductive rings (50) will become engaged with a contact element (54) at some point during the rotation of the conductive rings (50).

The size of a contact element engagement surface (72) depends upon the size, shape and configuration of its respective contact element (54). In some embodiments, a contact element engagement surface (72) may consist only of a point or a leading edge of its respective contact element (54). In some embodiments, a contact element (54) may define a planar or curved area which engages with a conductive ring (50) and which provides the contact element engagement surface (72).

In the exemplary embodiment in which the contact elements (54) are comprised of elongated flat metal fingers or strips, the contact element engagement surfaces (72) are comprised of planar or curved areas at the distal ends of the contact elements (54).

A surface discontinuity (80) is provided in at least one conductive ring engagement surface (70) and/or in at least one contact element engagement surface (72).

In some embodiments in which a contact element (54) is comprised of a brush or a similar structure, the brush or similar structure may define both a contact element engagement surface (72) and a surface discontinuity (80).

In the exemplary embodiment, a surface discontinuity (80) is provided in at least one of the conductive ring engagement surface (70) and the contact element engagement surface (72) for each engagement between a conductive ring (50) and a contact element (54).

In the exemplary embodiment, a surface discontinuity (80) may therefore be provided along the circumferential length of the conductive ring engagement surface (70) and/or on the planar or curved surface which defines the contact element engagement surface (72) on the contact element (54).

In the exemplary embodiment, each surface discontinuity (80) is comprised of a surface discontinuity pattern. In the exemplary embodiment, each surface discontinuity (80) may be comprised of a plurality of grooves (82). The surface discontinuity patterns may be the same or may vary throughout the slip ring apparatus (20). The surface discontinuity patterns which are provided in a conductive ring engagement surface (70) and a corresponding contact element engagement surface (72) for a particular engagement may be the same or may be different.

In the exemplary embodiment, the surface discontinuity patterns are selected to avoid preventing a continuous electrical connection between a conductive ring (50) and a contact element (54) during relative rotation of the conductive ring (50) and the contact element (54).

Referring to FIGS. 3A-3H, non-limiting exemplary embodiments of surface discontinuities (80) and/or surface discontinuity patterns, or portions thereof, all comprising grooves (82), are depicted schematically and not to scale. These surface discontinuities (80) and/or surface discontinuity patterns may be provided in a conductive ring engagement surface (70) and/or in a suitable shape of contact element engagement surface (72), and may be extended or repeated in either a conductive ring engagement surface (70) or a suitable shape of contact element engagement surface (72), as required.

The grooves (82) in the surface discontinuities (80) and/or surface discontinuity patterns depicted in the exemplary embodiments in FIGS. 3A-3H may have any suitable thickness, depth and/or cross-section.

Figures 3A, 3B:
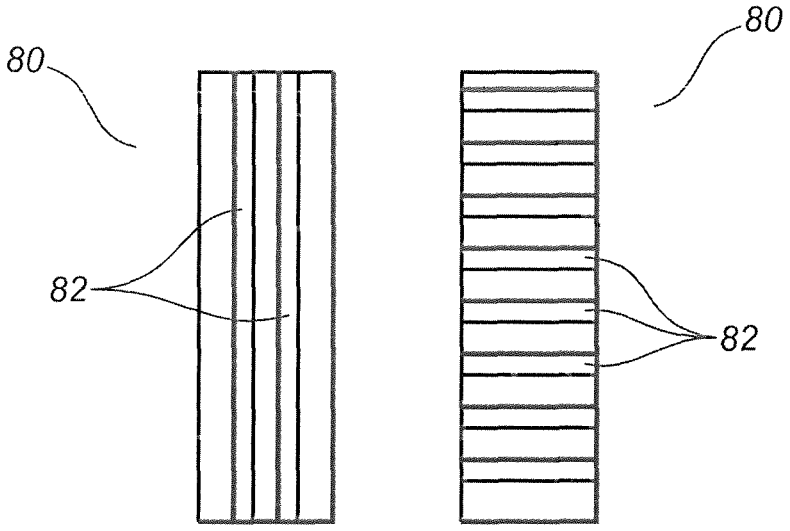
FIGS. 3A-3H are schematic plan views of exemplary surface discontinuity patterns which may be provided in a conductive ring engagement surface and/or in a contact element engagement surface.
Figures 3C, 3D:
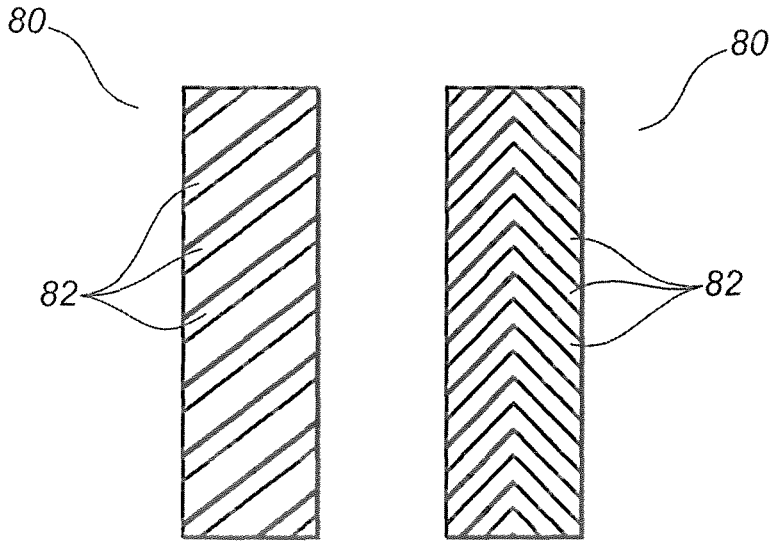
Figures 3E, 3F:
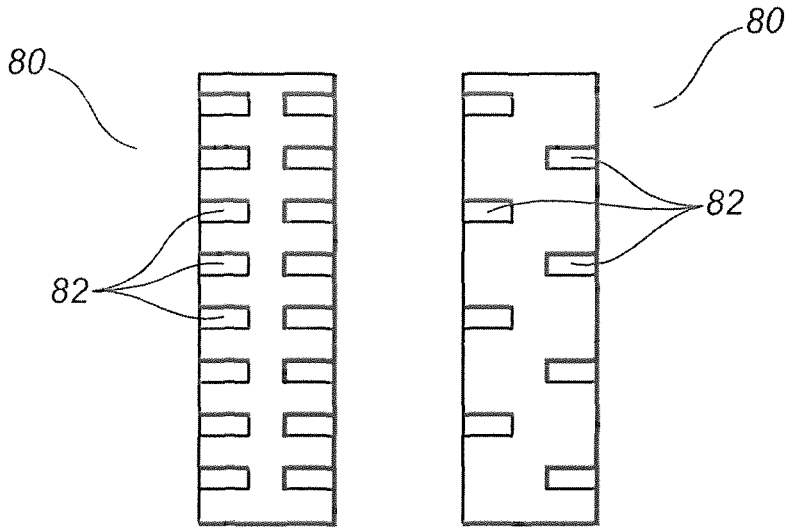
Figures 3G, 3H:
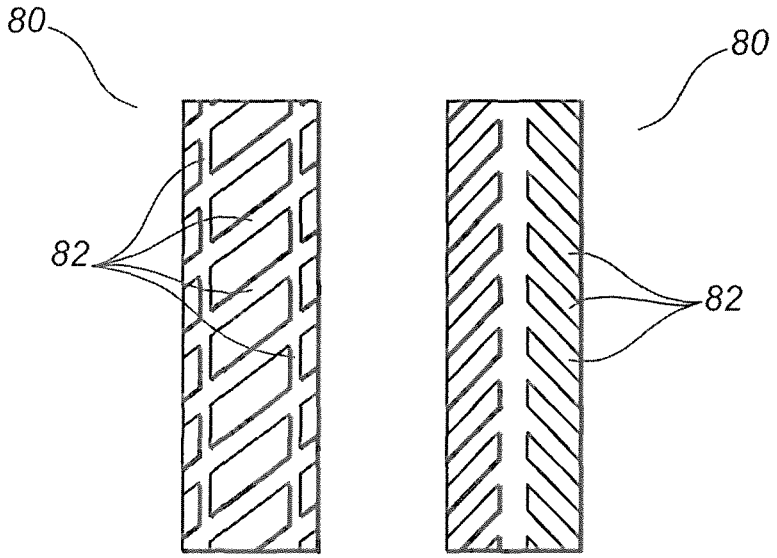

In FIG. 3A, the surface discontinuity (80) is comprised of a plurality of straight longitudinal grooves (82) which extend for the full length of an engagement surface (70, 72). In FIG. 3B, the surface discontinuity (80) is comprised of a plurality of straight transverse grooves which extend across the entire width of an engagement surface (70, 72). In FIG. 3C, the surface discontinuity (80) is comprised of a plurality of straight oblique grooves which extend across the entire width of an engagement surface (70, 72). In FIG. 3D, the surface discontinuity (80) is comprised of a plurality of symmetrical segmented oblique grooves which extend across the entire width of an engagement surface (70, 72). In FIG. 3E, the surface discontinuity (80) is comprised of a plurality of straight symmetrical transverse grooves which extend across a portion of the width of an engagement surface (70, 72). In FIG. 3F, the surface discontinuity (80) is comprised of a plurality of straight staggered transverse grooves which extend across a portion of the width of an engagement surface (70, 72). In FIG. 3G, the surface discontinuity (80) is comprised of a combination of a plurality of straight oblique grooves which extend across the entire width of an engagement surface (70, 72) and a plurality of straight longitudinal grooves which extend for the full length of an engagement surface (70, 72). In FIG. 3H, the surface discontinuity (80) is comprised of a plurality of symmetrical segmented oblique grooves which extend across a portion of the width of an engagement surface (70, 72).

The presence of a surface discontinuity (80) and/or surface discontinuity pattern in a conductive ring engagement surface (70) and/or in a contact element engagement surface (72) may assist in reducing potential hydroplaning between a conductive ring (50) and a contact element (52) by dissipating the pressure of a fluid such as a dielectric fluid (62) which may be present between the engagement surfaces (70, 72), by providing areas or paths for the fluid between the engagement surfaces (70, 72).

The presence of a surface discontinuity (80) and/or surface discontinuity pattern in a conductive ring engagement surface (70) and/or in a contact element engagement surface (72) may also enable the surface discontinuity (80) and/or the surface discontinuity pattern to be used to gauge the condition of a conductive ring (50) and/or a contact element (52), by providing a wear indicator function.

As a result, a slip ring apparatus which comprises a surface discontinuity (80) and/or a surface discontinuity pattern as described herein may be effective for use in a method for reducing the potential of a hydroplaning effect between a conductive ring (50) and a contact element (52), and/or in a method for providing an indication of the condition of a conductive ring (50) and/or a contact element (52).

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

I claim:

1. A slip ring apparatus comprising:

(a) a ring assembly, wherein the ring assembly is comprised of an electrically conductive ring, and wherein the conductive ring is comprised of a conductive ring engagement surface;

(b) a contact assembly, wherein the contact assembly is comprised of an electrically conductive contact element for engaging with the conductive ring, wherein the contact element is an elongated flat metal strip, and wherein the contact element is comprised of a contact element engagement surface for engaging with the conductive ring engagement surface; and (c) a surface discontinuity provided in at least the contact element engagement surface, wherein the surface discontinuity is comprised of a texture in the contact element engagement surface which interrupts a smoothness in the contact element engagement surface without preventing a continuous electrical connection between the conductive ring and the contact element.

2. The slip ring apparatus as claimed in claim 1 wherein the surface discontinuity is provided in the conductive ring engagement surface and in the contact element engagement surface.

3. The slip ring apparatus as claimed in claim 1 wherein the surface discontinuity is comprised of a surface discontinuity pattern comprising a plurality of grooves.

4. The slip ring apparatus as claimed in claim 3 wherein the plurality of grooves is selected from the group consisting of longitudinal grooves, transverse grooves, oblique grooves, and combinations thereof.

5. The slip ring apparatus as claimed in claim 4 wherein the surface discontinuity pattern is provided in the conductive ring engagement surface and in the contact element engagement surface.

6. The slip ring apparatus as claimed in claim 5 wherein a first surface discontinuity pattern is provided in the conductive ring engagement surface, wherein a second surface discontinuity pattern is provided in the contact element engagement surface, and wherein the first surface discontinuity pattern is different from the second surface discontinuity pattern.

7. The slip ring apparatus as claimed in claim 1 wherein an extent to which the surface discontinuity is recognizable provides an indicator of wear so that the surface discontinuity provides a wear indicator function.

8. The slip ring apparatus as claimed in claim 1 wherein the ring assembly is comprised of a plurality of conductive rings, wherein each of the conductive rings is comprised of the conductive ring engagement surface, wherein the contact assembly is comprised of a plurality of contact elements for engaging with the plurality of conductive rings, wherein each of the contact elements is an elongated flat metal strip, wherein each of the contact elements is comprised of the contact element engagement surface for engaging with one of the conductive ring engagement surfaces, and wherein the surface discontinuity is provided in at least each of the contact element engagement surfaces.

9. The slip ring apparatus as claimed in claim 1 wherein the slip ring apparatus is comprised of a plurality of contact assemblies, wherein each of the contact assemblies is comprised of a contact element for engaging with the conductive ring, wherein each of the contact elements is an elongated flat metal strip, wherein each of the contact elements is comprised of the contact element engagement surface for engaging with the conductive ring engagement surface, and wherein the surface discontinuity is provided in at least each of the contact element engagement surfaces.

10. The slip ring apparatus as claimed in claim 1 wherein the ring assembly is comprised of a plurality of conductive rings, wherein each of the conductive rings is comprised of a conductive ring engagement surface, wherein the slip ring apparatus is comprised of a plurality of contact assemblies, wherein each of the contact assemblies is comprised of a plurality of contact elements for engaging with the plurality of conductive rings, wherein each of the contact elements is an elongated flat metal strip, wherein each of the contact elements is comprised of the contact element engagement surface for engaging with one of the conductive ring engagement surfaces, and wherein the surface discontinuity is provided in at least each of the contact element engagement surfaces.

11. The slip ring apparatus as claimed in claim 1 wherein the slip ring apparatus is immersed in a dielectric fluid.

12. An apparatus comprising:

(a) a housing having an interior;

(b) a shaft rotatably extending through the interior of the housing;

(c) a slip ring apparatus for transferring electrical energy between the housing and the shaft, the slip ring apparatus comprising:

(i) a ring assembly associated with one of the housing and the shaft, wherein the ring assembly is comprised of an electrically conductive ring, and wherein the conductive ring is comprised of a conductive ring engagement surface;

(ii) a contact assembly associated with the other of the housing and the shaft, wherein the contact assembly is comprised of an electrically conductive contact element for engaging with the conductive ring, wherein the contact element is an elongated flat metal strip, and wherein the contact element is comprised of a contact element engagement surface for engaging with the conductive ring engagement surface; and (iii) a surface discontinuity provided in at least the contact element engagement surface, wherein the surface discontinuity is comprised of a texture in the contact element engagement surface which interrupts a smoothness in the contact element engagement surface without preventing a continuous electrical connection between the conductive ring and the contact element.

13. The apparatus as claimed in claim 12 wherein the surface discontinuity is comprised of a surface discontinuity pattern comprising a plurality of grooves.

14. The apparatus as claimed in claim 13 wherein the plurality of grooves is selected from the group consisting of longitudinal grooves, transverse grooves, oblique grooves, and combinations thereof.

15. The apparatus as claimed in claim 12 wherein an extent to which the surface discontinuity is recognizable provides an indicator of wear so that the surface discontinuity provides a wear indicator function.

16. The apparatus as claimed in claim 12 wherein the slip ring apparatus is immersed in a dielectric fluid.

17. The apparatus as claimed in claim 12 wherein the apparatus is an apparatus for use in drilling a borehole.

18. The apparatus as claimed in claim 12 wherein the apparatus is a rotary steerable drilling apparatus for use in drilling a borehole.

19. A method for reducing the potential of a hydroplaning effect in a slip ring apparatus comprising a ring assembly and a contact assembly, the method comprising:

(a) providing the ring assembly, wherein the ring assembly is comprised of an electrically conductive ring, and wherein the conductive ring is comprised of a conductive ring engagement surface;

(b) providing the contact assembly, wherein the contact assembly is comprised of an electrically conductive contact element for engaging with the conductive ring, wherein the contact element is an elongated flat metal strip, and wherein the contact element is comprised of a contact element engagement surface for engaging with the conductive ring engagement surface; and (c) providing a surface discontinuity in at least the contact element engagement surface, wherein the surface discontinuity is comprised of a texture in the contact element engagement surface which interrupts a smoothness in the contact element engagement surface without preventing a continuous electrical connection between the conductive ring and the contact element.

20. The method as claimed in claim 19, further comprising using the surface discontinuity to provide an indication of the condition of at least one of the conductive ring and the contact element.

* * * * *